US011202468B2

(12) United States Patent
Babi et al.

(10) Patent No.: US 11,202,468 B2
(45) Date of Patent: Dec. 21, 2021

(54) PACKAGE FOR ROLLING PAPERS, FILTERS, SCOOPER SLEEVE AND PACKING STICK USED IN SMOKING ARTICLES

(71) Applicants: Michael G Babi, West Bloomfield, MI (US); Anes S Kashat, Walled Lake, MI (US)

(72) Inventors: Michael G Babi, West Bloomfield, MI (US); Anes S Kashat, Walled Lake, MI (US)

( * ) Notice: Subject to any disclaimer, the term of this patent is extended or adjusted under 35 U.S.C. 154(b) by 318 days.

(21) Appl. No.: 16/278,161

(22) Filed: Feb. 17, 2019

(65) Prior Publication Data

US 2020/0260781 A1 Aug. 20, 2020

(51) Int. Cl.
*A24F 17/00* (2006.01)
*A24D 1/02* (2006.01)

(52) U.S. Cl.
CPC ..... *A24F 17/00* (2013.01); *A24D 1/022* (2013.01)

(58) Field of Classification Search
None
See application file for complete search history.

(56) References Cited

U.S. PATENT DOCUMENTS 587,570 A * 8/1897 Fitz Gerald ..... A24C 5/42 131/75
7,611,014 B2 11/2009 Portella Bobe et al.
8,584,854 B2 11/2013 Kesselman et al.
8,662,086 B2 3/2014 Kesselman
9,113,658 B1 8/2015 Sinclair, Jr.
9,521,866 B2 12/2016 Koester et al.
(Continued)

*Primary Examiner* — Francisco W Tschen
*Assistant Examiner* — Guy F Mongelli
(74) *Attorney, Agent, or Firm* — Mastrogiacomo PLLC; Patrick Mastrogiacomo, Jr.

(57) ABSTRACT

A package for containing rolling papers used in at least one smoking article to be dispensed therefrom, the package comprising a plurality of rolling papers, the rolling papers including a crease to capture a smoking product on the rolling papers and the rolling papers being rolled into a cylindrical shape to capture the smoking product within the rolling papers to create the at least one smoking article, a base, the base including a container, the container sized for holding the rolling papers and the container including a slot to dispense the rolling papers, the rolling papers used to fabricate hand rolled cigarettes, a first tab, the first tab extending outward the said base at a wide side of the base, a cover, the cover extending outward from the first tab, a second tab, the second tab extending outward from the cover at a wide side of the cover a scooper sleeve, the scooper sleeve extending outward from the second tab, a spine, the spine extending outward and perpendicular from the cover, a plurality of filter tips, the filter tips secured to the cover at the spine and the filter tips extending outward from the spine, a packing stick, a sleeve, the sleeve formed at an intersection of the first tab and the cover; the sleeve sized to secure the packing stick within an interior of the package and wherein the scooper sleeve is folded at the second tab onto the filter tabs and the base is folded at the first tab onto the scooper sleeve to enable the package to be folded upon itself and stored compactly.

7 Claims, 19 Drawing Sheets

(56) References Cited

U.S. PATENT DOCUMENTS

| | | | | |
|---|---|---|---|---|
| 2009/0075798 | A1* | 3/2009 | Garthaffner | A24D 3/0287 493/48 |
| 2010/0269839 | A1* | 10/2010 | Kaljura | A24D 1/006 131/58 |
| 2012/0138075 | A1* | 6/2012 | Jespersen | A24D 3/04 131/280 |
| 2012/0167900 | A1* | 7/2012 | Staric | A24C 5/44 131/27.1 |
| 2013/0213993 | A1 | 8/2013 | Dangarembizi | |
| 2015/0090275 | A1* | 4/2015 | Kesselman | A24D 1/02 131/105 |

* cited by examiner

PACKAGE FOR ROLLING PAPERS, FILTERS, SCOOPER SLEEVE AND PACKING STICK USED IN SMOKING ARTICLES

CROSS REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON COMPACT DISC

Not Applicable

BACKGROUND OF THE INVENTION

1. Field of the Invention

The present invention relates generally to the field of products used by individuals to produce smoking articles for personal consumption and, more particularly, to improvements in a package to house rolling papers, filters, a scooper sleeve and a packing stick to improve the burning efficiency of the smoking articles and enhance the overall smoking enjoyment for the consumer.

2. Background Art

For the several hundreds of years, individuals have been using multiple mediums to inhale smoke and consume ingredients from the burning of tobacco leaves and other products. Pipes, hookahs, tobacco leaves and paper products have been the choice of many as the vessel to capture tobacco or similar products so that the tobacco may be burned and the active ingredients in tobacco inhaled for the pleasure of many.

The hand rolling of tobacco in a paper product has been a choice among smokers for several hundred years as well. It is much easier to produce several hand rolled cigarettes for personal consumption than it is to carry a pipe and a separate package of tobacco and prepare a pipe for smoking when the time suits the individual. It is certainly more convenient to carry hand rolled cigarettes than it is to carry a hookah and a separate package of tobacco. The convenience of hand rolled cigarettes for personal consumption certainly is beneficial to many.

Large cigarette producing companies recognized the convenience individual's enjoyed from hand rolled cigarettes and began producing mass quantities of cigarettes for personal consumption. Many individuals abandoned the hand rolling of their own cigarettes for the convenience of purchasing already made cigarettes from the cigarette manufacturers.

Within the last several years, many consumers of tobacco through cigarettes have resorted back to producing their own cigarettes for personal consumption due to the ever-increasing cost and expense of purchasing cigarettes produced by manufactures and for personal choice and enjoyment. It is less expensive for an individual to purchase tobacco and rolling papers in bulk and produce their own cigarettes than purchasing a pack of pre-made cigarettes from cigarette manufactures. Furthermore, a number of states have passed laws allowing for the personal consumption of marijuana for medical and recreational use. One of the most popular means for absorbing the ingredients of marijuana into the body is through a hand rolled cigarette.

Rolling papers for cigarettes have been in existence almost as long as tobacco itself. As stated above, individuals produced their own cigarettes long before the large manufacturers began producing cigarettes in bulk. One of the drawbacks of a hand rolled cigarette is the lack of consistency in the amount of tobacco or marijuana that may be contained in any one cigarette. While people can weigh the tobacco to produce a consistent weight of tobacco in the cigarette, it is often cumbersome and increases the amount of time to process each cigarette. Further, the density of the tobacco packed within the rolling papers is often inconsistent as well leading to an uneven burn of the cigarette thereby impacting the users enjoyment of smoking the cigarette. While the large cigarette manufacturers may have solved both the consistent weight and uniform density issues with tobacco cigarettes, the issues still continue to plague individual producers of had rolled cigarettes for personal consumption to this day.

Therefore, a need exists for a package of rolling papers that is compact for ease of storage and includes means that enables an individual to produce inexpensive hand rolled cigarettes that have a consistent amount of tobacco or other smoking substance, and density to ensure a steady burn rate of the tobacco and like materials thereby leading to an improved smoking experience for the individual.

BRIEF SUMMARY OF THE INVENTION

A package for containing rolling papers used in at least one smoking article to be dispensed therefrom, the package comprising a plurality of rolling papers, the rolling papers including a crease to capture a smoking product on the rolling papers and the rolling papers being rolled into a cylindrical shape to capture the smoking product within the rolling papers to create the at least one smoking article, a base, the base including a container, the container sized for holding the rolling papers and the container including a slot to dispense the rolling papers, the rolling papers used to fabricate hand rolled cigarettes, a first tab, the first tab extending outward the said base at a wide side of the base, a cover, the cover extending outward from the first tab, a second tab, the second tab extending outward from the cover at a wide side of the cover a scooper sleeve, the scooper sleeve extending outward from the second tab, a spine, the spine extending outward and perpendicular from the cover, a plurality of filter tips, the filter tips secured to the cover at the spine and the filter tips extending outward from the spine, a packing stick, a sleeve, the sleeve formed at an intersection of the first tab and the cover; the sleeve sized to secure the packing stick within an interior of the package and wherein the scooper sleeve is folded at the second tab onto the filter tabs and the base is folded at the first tab onto the scooper sleeve to enable the package to be folded upon itself and stored compactly.

BRIEF DESCRIPTION OF THE SEVERAL VIEWS OF THE DRAWINGS

The features and inventive aspects of the present invention will become more apparent from the following detailed description, claims, and drawings, of which the following is a brief description:

DETAILED DESCRIPTION OF THE INVENTION

Figure 1:
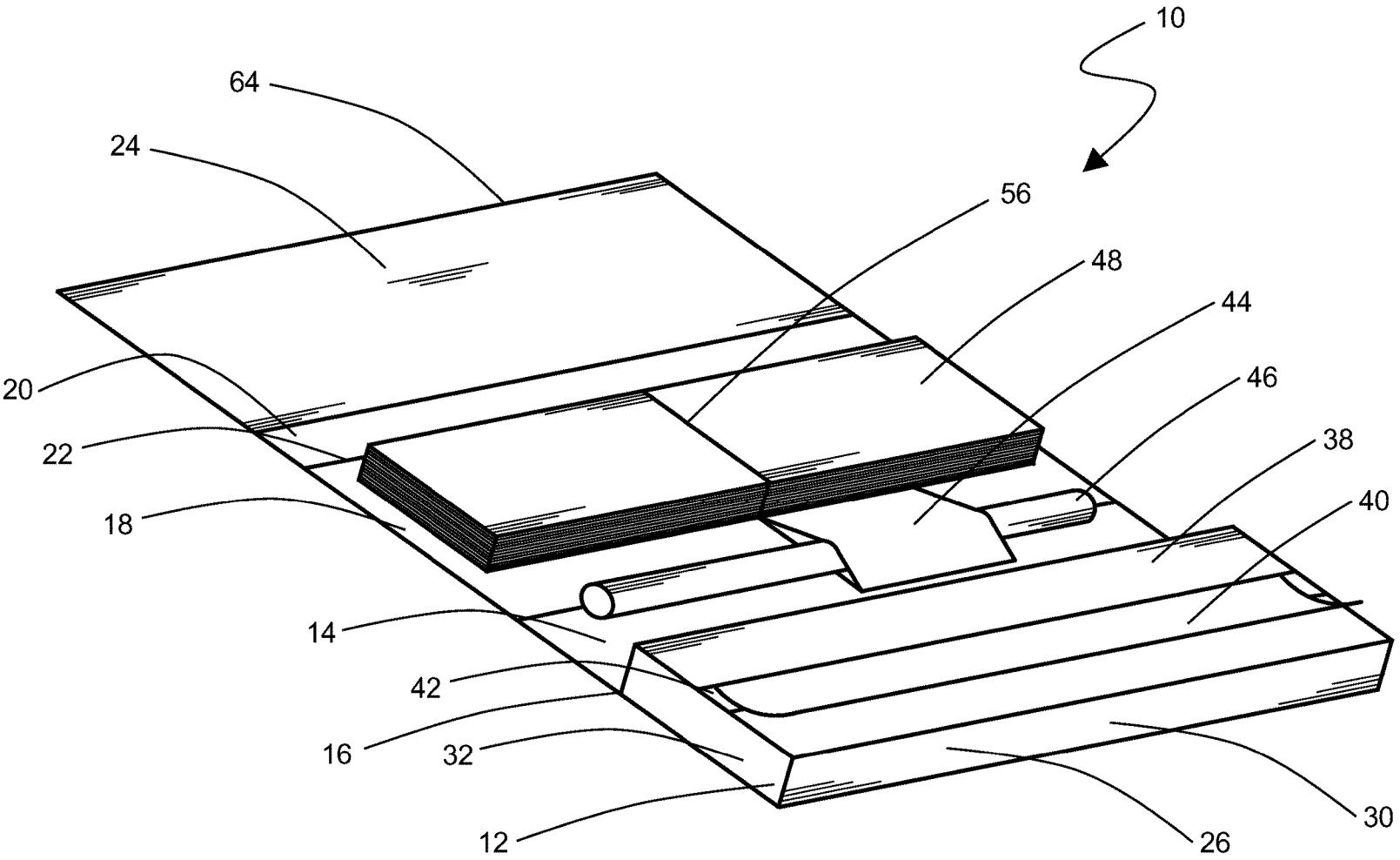
FIG. 1 is a perspective view of a package for cigarette rolling papers according to an embodiment of the present invention.
Figure 2:
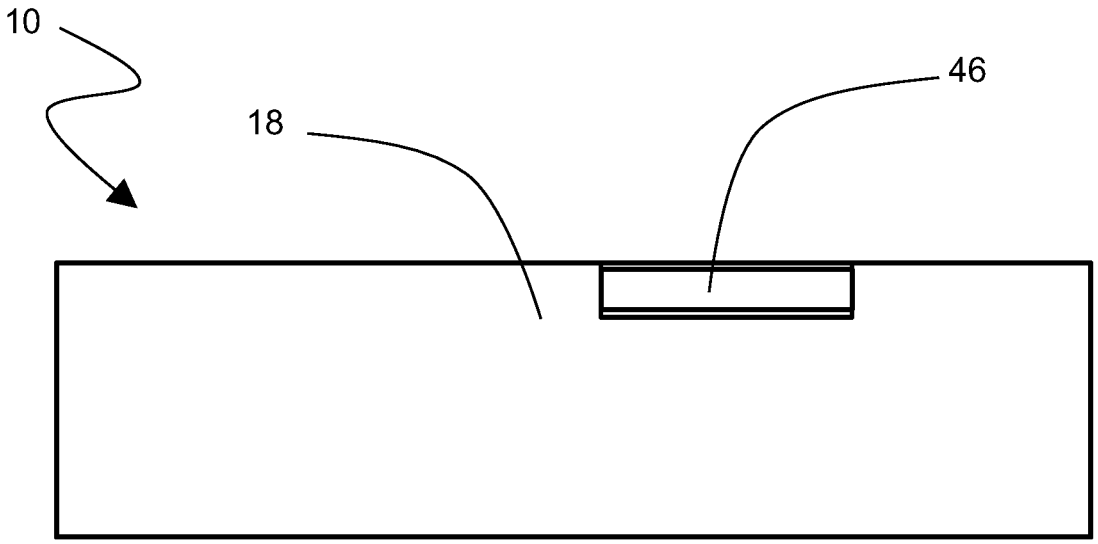
FIG. 2 is a top view of a package for cigarette rolling papers according to an embodiment of the present invention.
Figure 3:
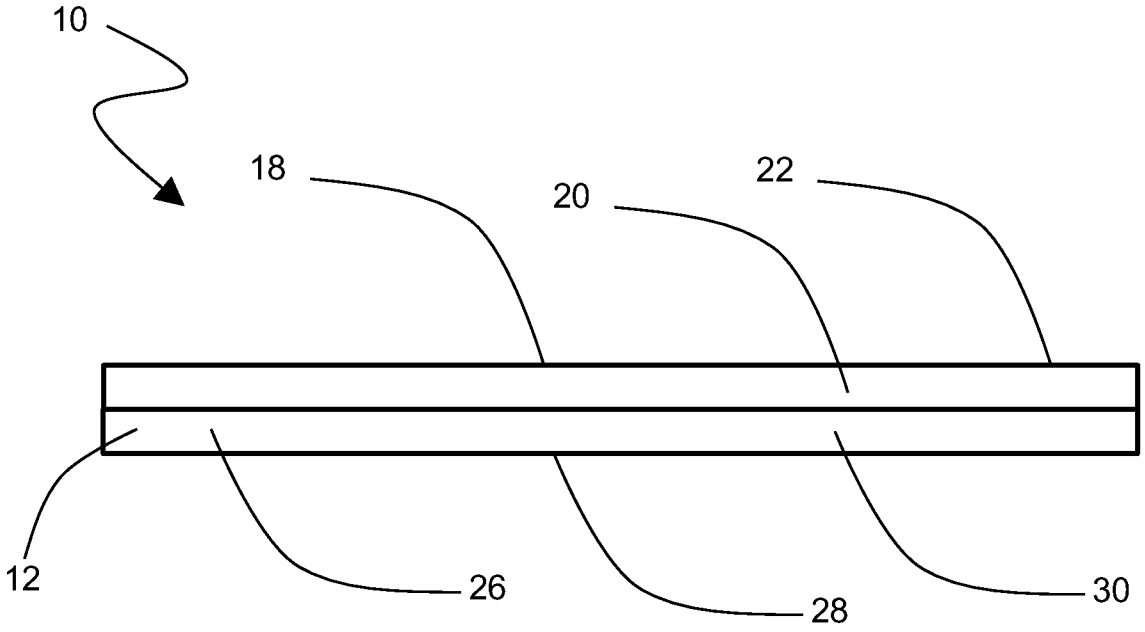
FIG. 3 is a first side view of a package for cigarette rolling papers according to an embodiment of the present invention.
Figure 4:
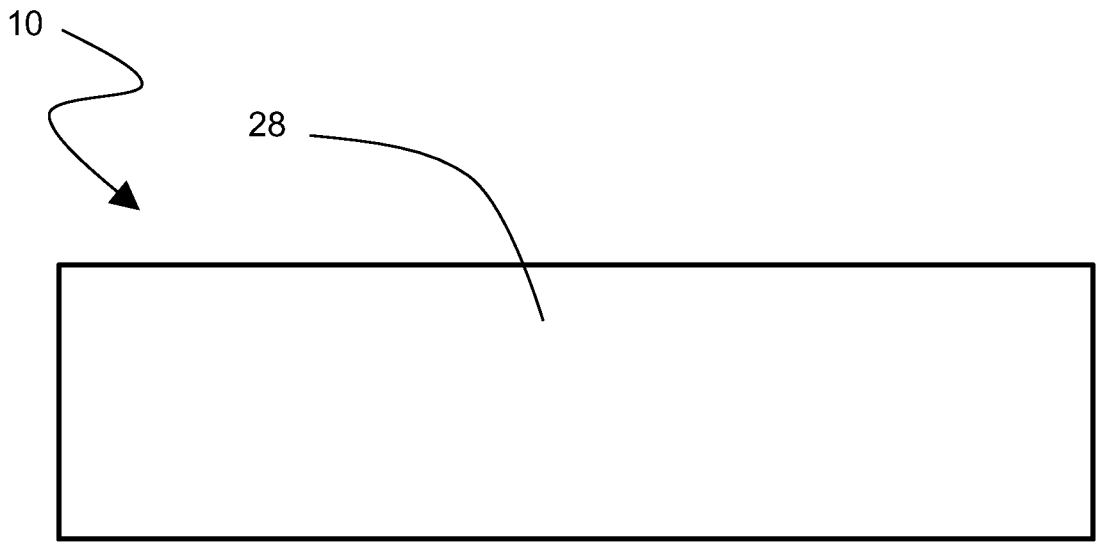
FIG. 4 is a bottom view of a package for cigarette rolling papers according to an embodiment of the present invention.
Figure 5:
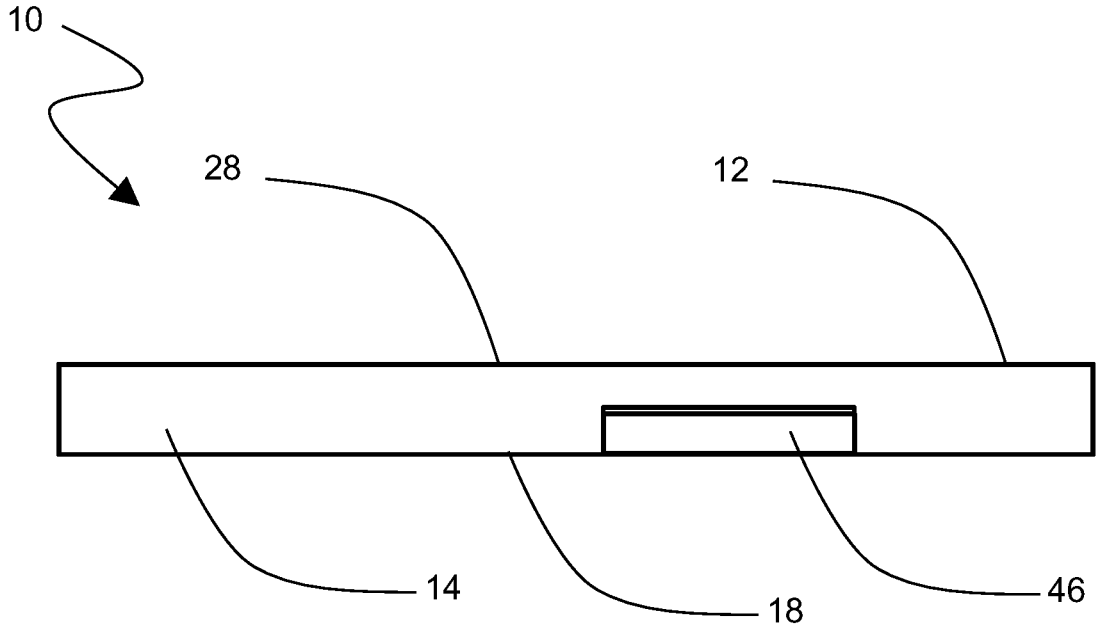
FIG. 5 is a second side view of a package for cigarette rolling papers according to an embodiment of the present invention.
Figure 6:
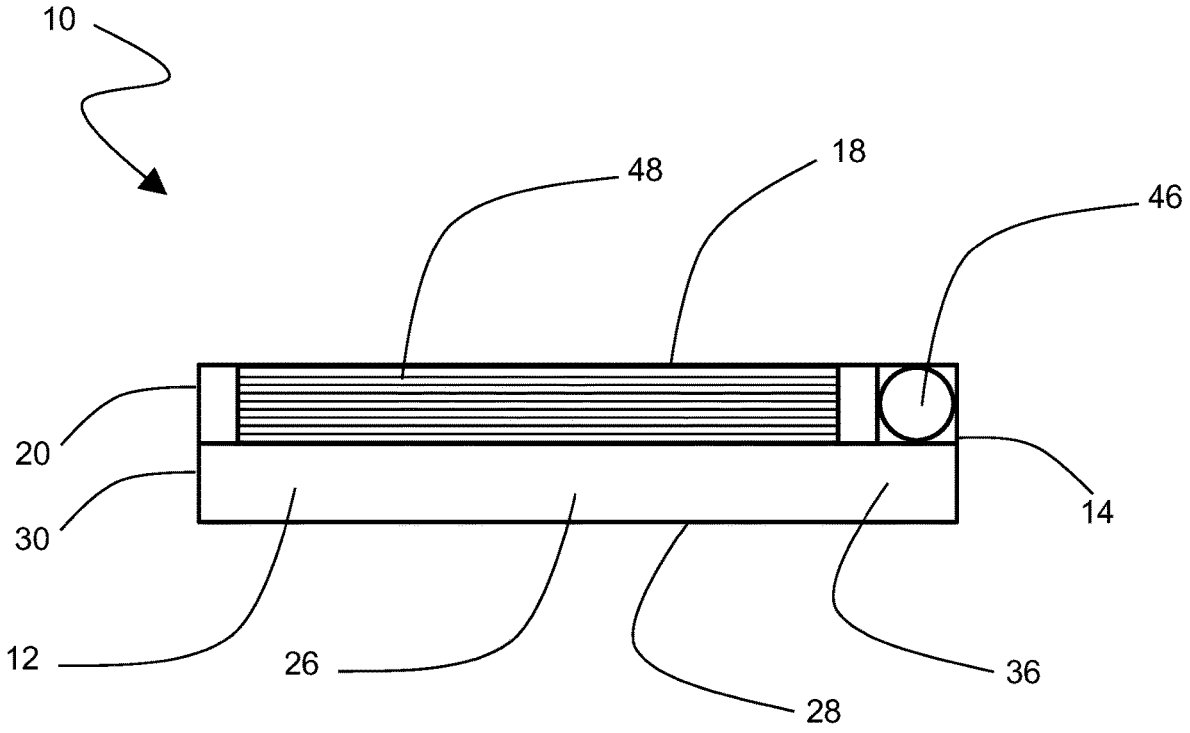
FIG. 6 is a third side view of a package for cigarette rolling papers according to an embodiment of the present invention.
Figure 7:
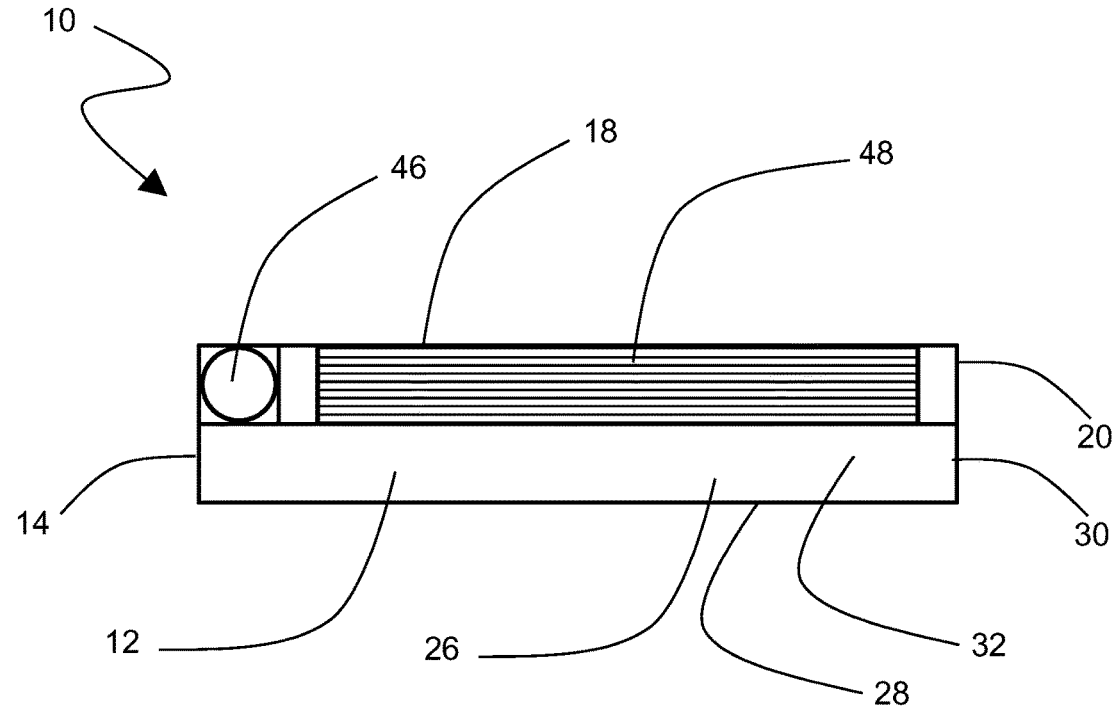
FIG. 7 is a fourth side view of a package for cigarette rolling papers according to an embodiment of the present invention.
Figure 8:
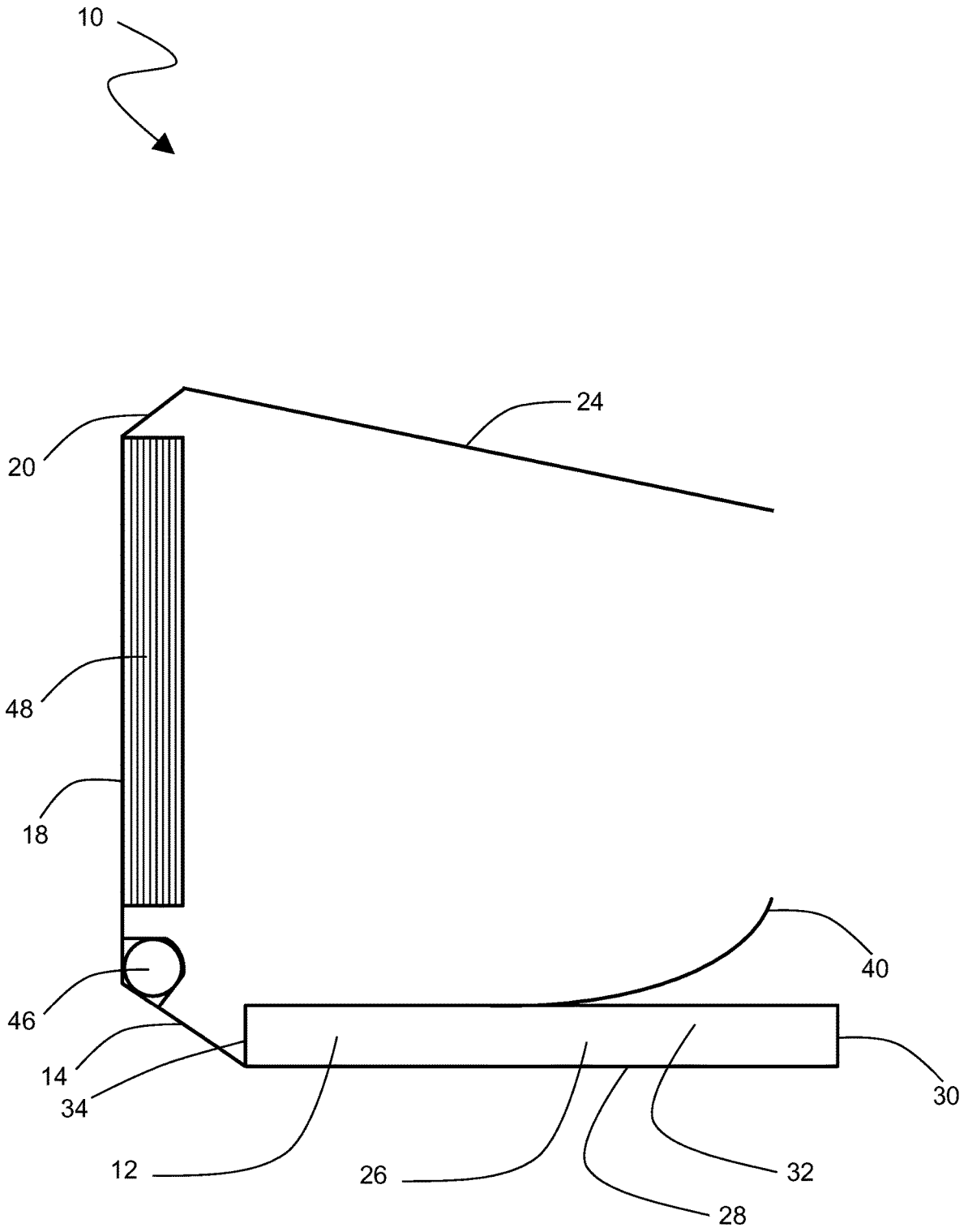
FIG. 8 is a fourth side view of an open package for cigarette rolling papers according to an embodiment of the present invention.
Figure 9:
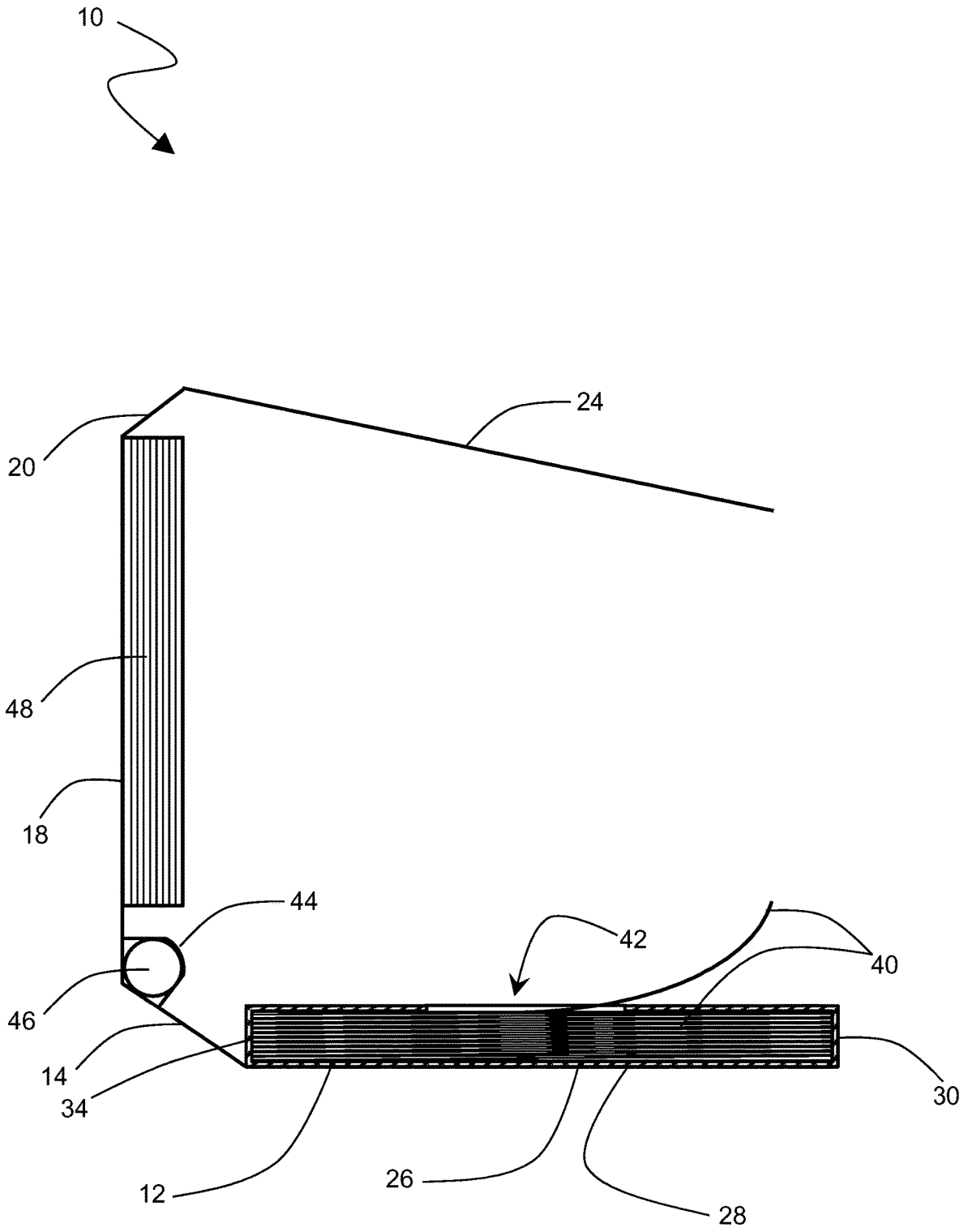
FIG. 9 is a cross-sectional fourth side view of an open package for cigarette rolling papers according to an embodiment of the present invention.

Referring now to the drawings, preferred illustrative embodiments of the present invention are shown in detail. Although the drawings represent embodiments of the present invention, the drawings are not necessarily to scale and certain features may be exaggerated to better illustrate and explain the present invention. Further, the embodiments set forth herein are not intended to be exhaustive or otherwise to limit or restrict the invention to the precise forms and configurations shown in the drawings and disclosed in the following detailed description.

A perspective view of an exemplary package for rolling papers to be used in the fabrication of hand rolled cigarettes for personal consumption is illustrated in FIG. 1. Package 10 includes a base 12 and a tab 14, tab 14 extending generally outward from a wide side 16 of base 12. Tab 14 secures a cover 18 to base 12. Cover 18 includes a second tab 20 that extends from a wide side 22 of cover 18. Package 10 further includes a scooper sleeve 24 that is secured to package 10 at tab 20. Package 10 may be manufactured of thick paper, cardboard, plastic, metal and like materials that are flexible yet durable to prevent damage to the various elements used to create smoking articles contained within package 10.

Package 10 according to an embodiment of the present invention is further illustrated in FIGS. 2-10. Base 12 includes a container 26, container 26 being generally shaped in a rectangular manner and including a bottom 28, four side walls, 30, 32, 34, 36 and a top 38. Four side walls 30, 32, 34, 36 extend generally upward from bottom 28 to support top 38 and create container 26 for housing a plurality of cellulose rolling papers 40. Top 38 includes a slot 42 that allows for rolling papers 40 to be removed from package 10. Rolling papers 40 are stored in an interleaved manner within container 26 to allow for a single rolling paper 40 to be removed from package 10 at any one time and to prepare the removal of subsequent rolling papers 40 from container 26.

First tab 14 includes a sleeve 44 for securing a packing stick 46 to package 10 at first tab 14. Sleeve 44 is a cut-out of first tab 14 and cover 18 near tab 14. Sleeve 44 is sized to secure stick 46 to package 10 while stick is not in use, yet allow an individual to easily remove packing stick 46 from package 10 when stick 46 is used to prepare the cigarette. Sleeve 44 is used to easily store packing stick 46 within package 10 and allow package 10 to be folded in a compact manner for easy storage.

Figure 10:
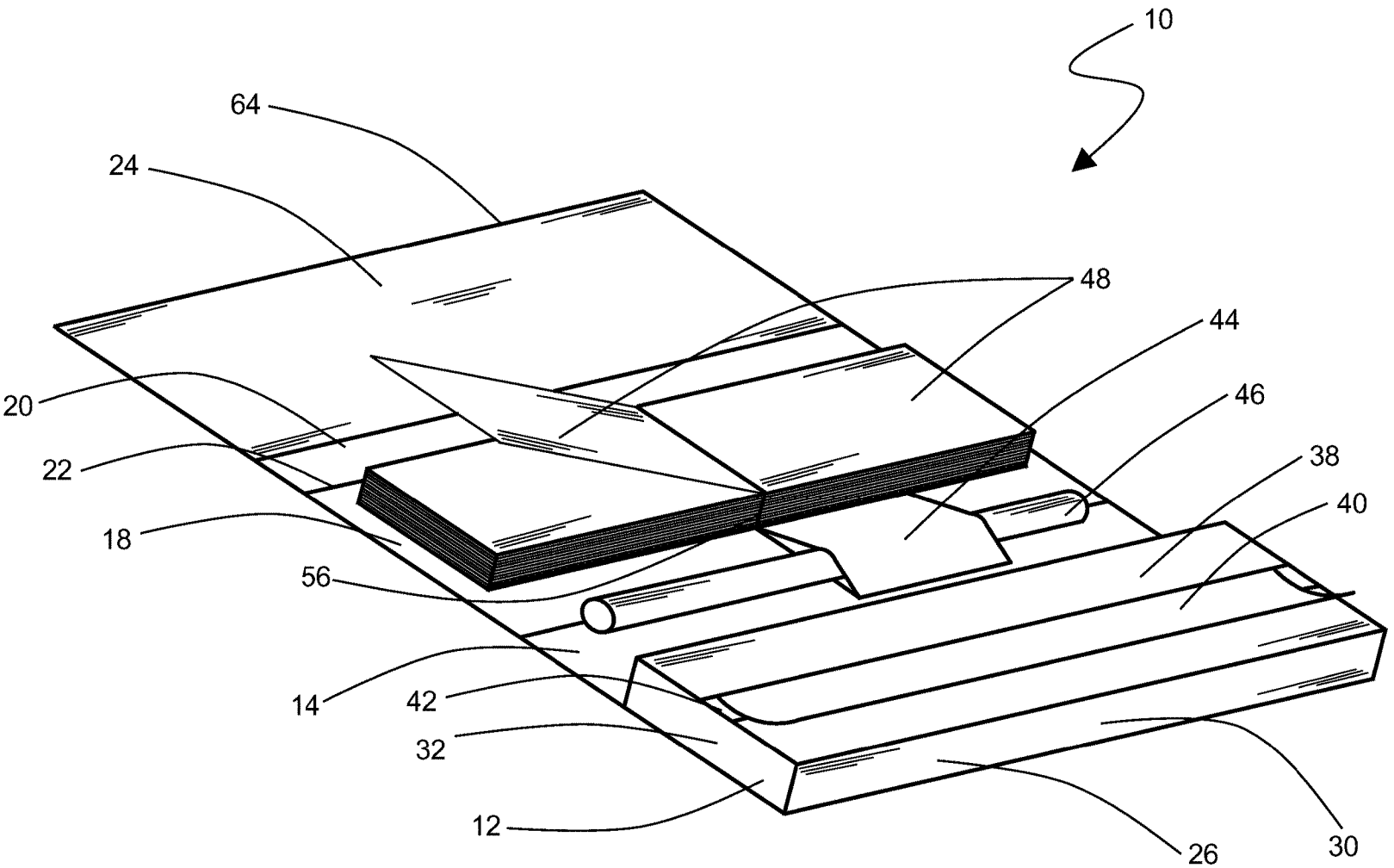
FIG. 10 is a perspective view of a package for cigarette rolling papers according to an embodiment of the present invention.

Cover 18 serves as the top cover for package 10 as depicted in FIGS. 2-7 when package 10 is folded upon itself for compact packaging for sale and storage while not in use. Cover 18 also secures a plurality of filter tips 48 to package 10. Filter tips 48 are secured to top cover 18 at spine 56 and in such a manner that allows one filter tip 48 to be removed from package 10 at a time as illustrated in FIG. 10.

Figure 12:
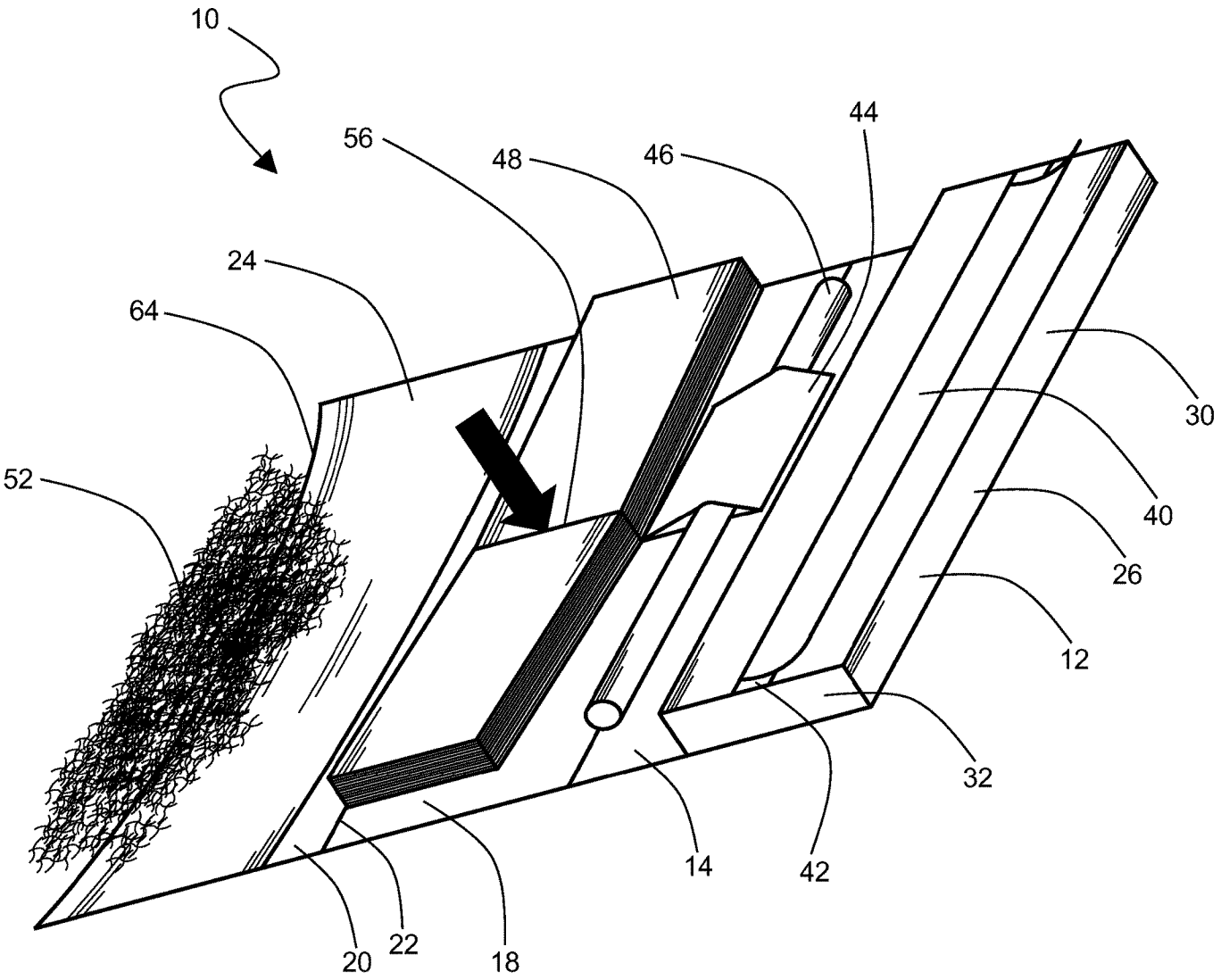
FIG. 12 is a perspective view of a package for cigarette rolling papers illustrating the collection of a smoking material in on the scooper sleeve according to an embodiment of the present invention.

Scooper sleeve 24 is sized to fold over and protect filter tips 48 when package 10 is not in use and folded in a compact manner for storage. In an unfolded position, scooper sleeve 24 may be used to scoop up any loose tobacco or tobacco like product as illustrated in FIG. 12. Sleeve 24 is sized to ensure the desired amount of tobacco or tobacco like product is scooped onto sleeve 24 for use in the cigarette. Sleeve 24 may be used in this manner to aid the individual in creating a hand rolled cigarette as will be fully detailed below.

Figure 11:
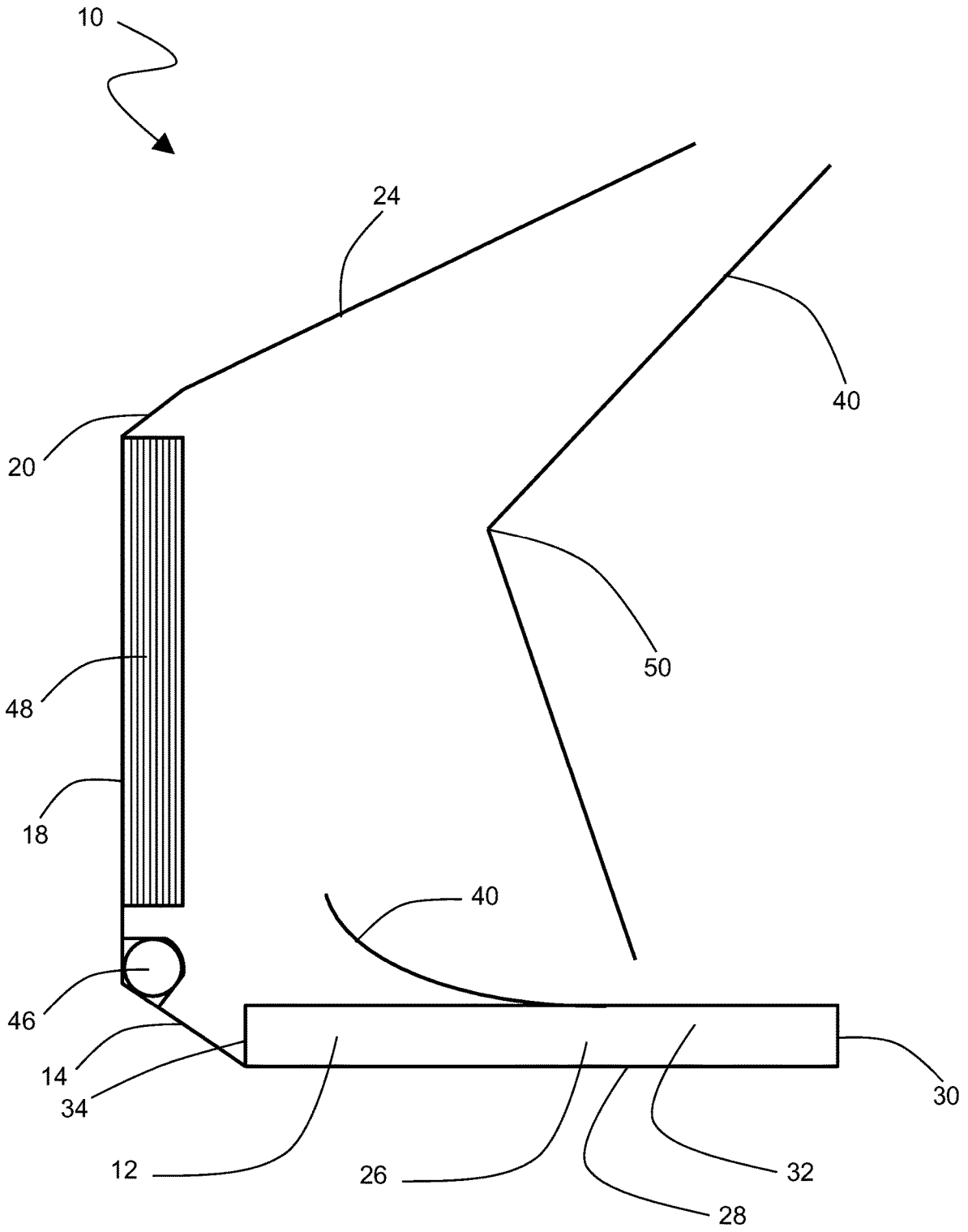
FIG. 11 is a fourth side view of a package for cigarette rolling papers illustrating a single rolling paper dispensed from the package according to an embodiment of the present invention.

An individual desiring to produce a quality hand rolled cigarette may open package 10 by pulling back cover 18 and scooper sleeve 24 from base 12 and exposing rolling papers 40. A single rolling paper 40 may be removed from package 10 at slot 42 of container 26 by simply pulling upward on the section of paper 40 that extends outward and is exposed from slot 42 as depicted in FIG. 11. As a single paper 40 is removed from container 26, a section from a second rolling paper 40 is introduced into slot 42 and is prepared for removal, although the portion of the second paper 40 that extends outward from slot 42 is now extending in an opposite direction from the previous paper 40. Removal of papers 40 from container 26 may continue in this manner until all the papers 40 have been removed from container 26 of package 10.

Figure 13:
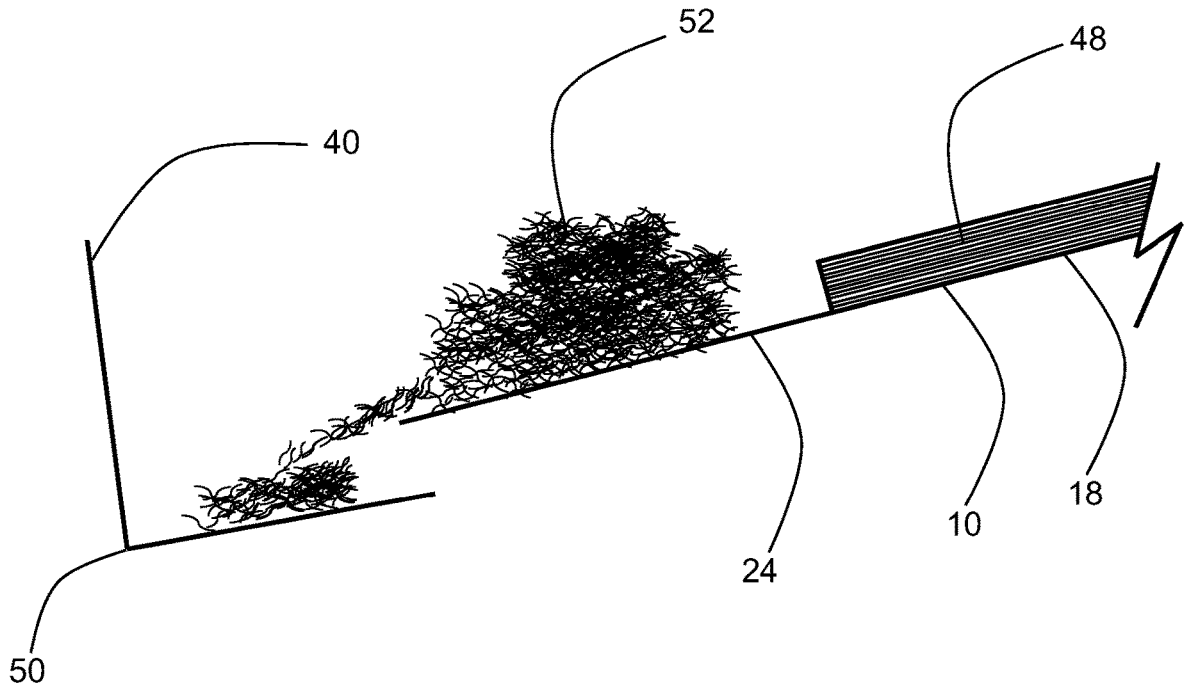
FIG. 13 is a side view of a rolling paper and a package for cigarette rolling papers illustrating the distribution of the smoking material onto the rolling papers according to an embodiment of the present invention.
Figure 14:
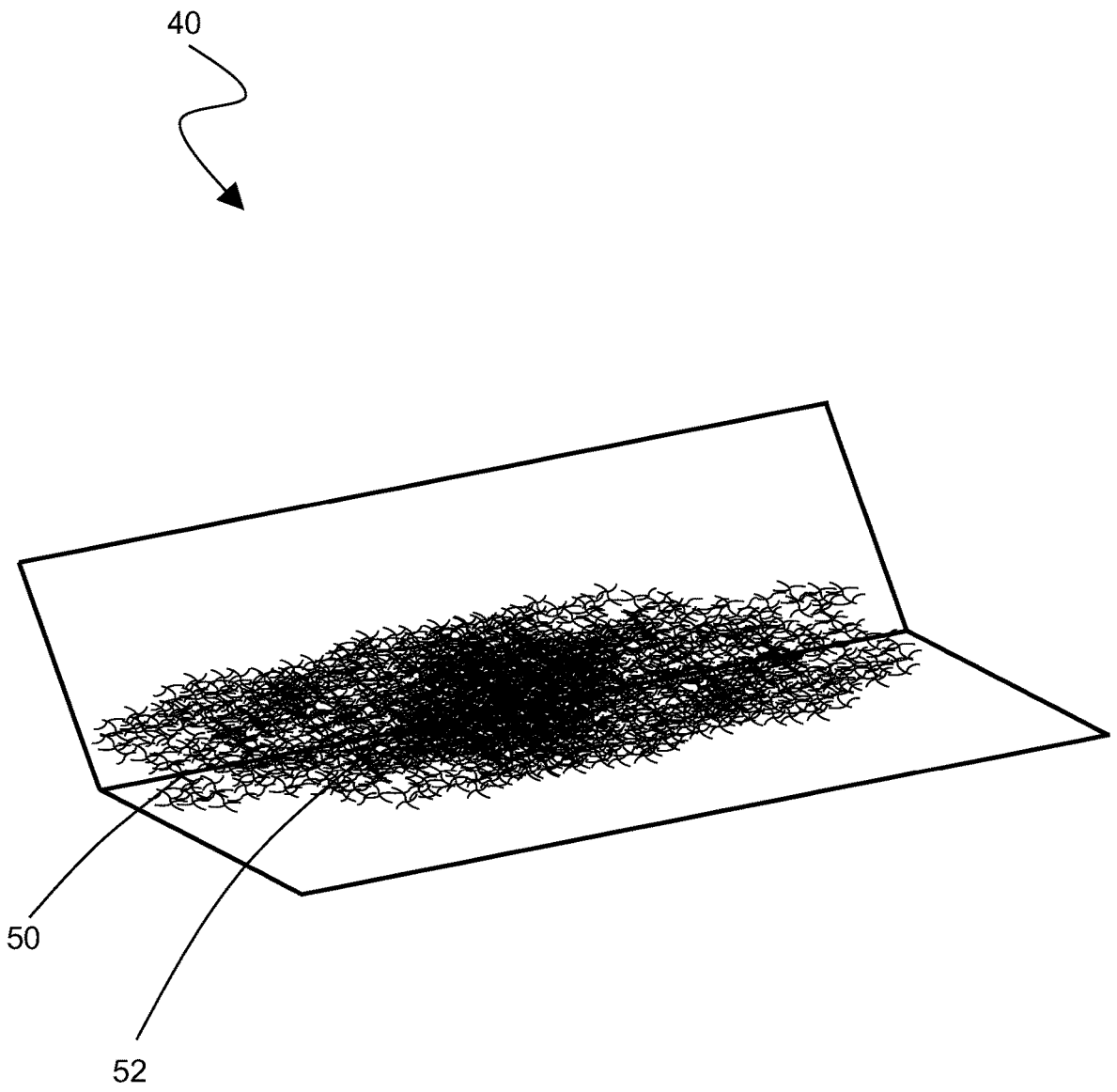
FIG. 14 is a perspective view of a rolling paper containing the smoking material according to an embodiment of the present invention.

After paper 40 has been removed from package 10, tobacco 52 and any smoking product or tobacco like product suitable for smoking may be added to papers 40 as illustrated in FIGS. 13 and 14. Rolling paper 40 may include a crease 50 for capturing tobacco product on paper 40. The tobacco product may be added to paper 40 at crease 50 to ensure that the tobacco product stays on paper 40.

As stated above, scooper sleeve 24 may be used to collect the tobacco product and introduce tobacco 52 to crease 50 of paper 40. FIG. 12 illustrates how scooper sleeve 24 may be used to collect the tobacco from a smooth surface such as a tabletop. According to an embodiment of the present invention, a small downward force may be applied at spine 56, as illustrated by the arrow in FIG. 12, this allows an edge 64 of scooper sleeve 24 to be rounded slightly and become rigid as edge 64 is moved across a smooth surface such as a table top to engage the tobacco product. As edge 64 engages the tobacco, tobacco 52 is swept onto scooper sleeve 24. Scooper sleeve 24 may continue to be moved toward the tobacco to collect the desired amount of tobacco on sleeve 24 for placement in paper 40. Once the desired amount of tobacco 52 is collected on sleeve 24, sleeve 24 may be introduced to paper 40 at crease 50 to deposit tobacco onto paper 40 as shown in FIG. 13.

With tobacco 52 now contained on paper 40, paper 40 may be rolled into a shape of a cylinder that resembles a cigarette 54 to capture the tobacco within paper 40 as depicted in FIGS. 15A-15E. Once the cigarette is formed, a long edge of paper 40 may be moistened and pressed against the portion of paper 40 it was folded upon to ensure the paper 40 is sealed upon itself and is formed in the cylinder that resembles a traditional cigarette.

Figure 15A:
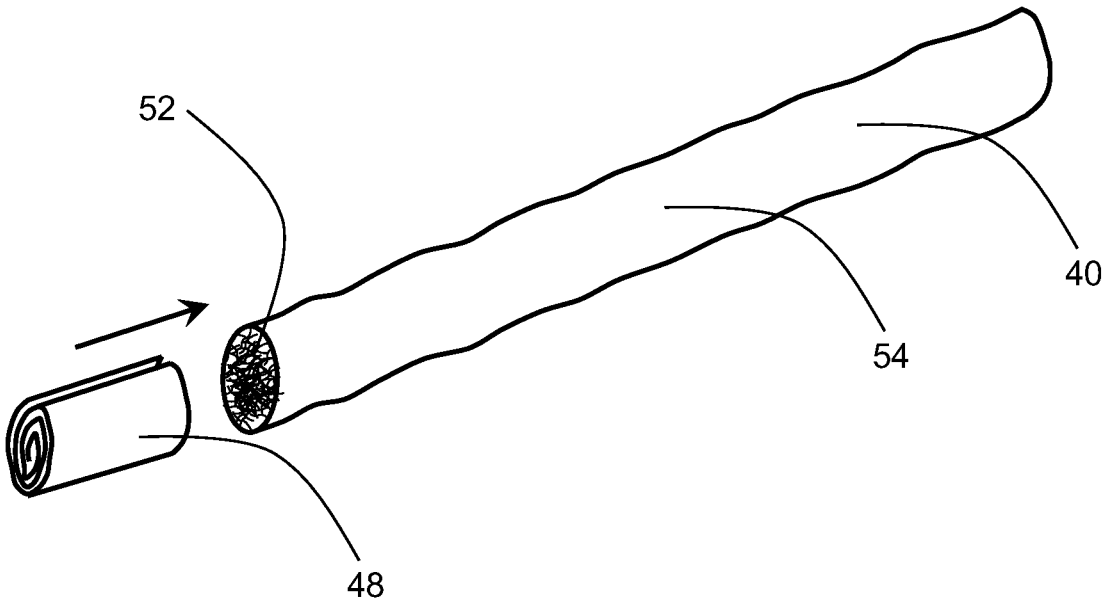
FIGS. 15A-15F are perspective views of a hand rolled cigarette illustrating the insertion of a filter and use of a packing stick according to an embodiment of the present invention.
Figure 15B:
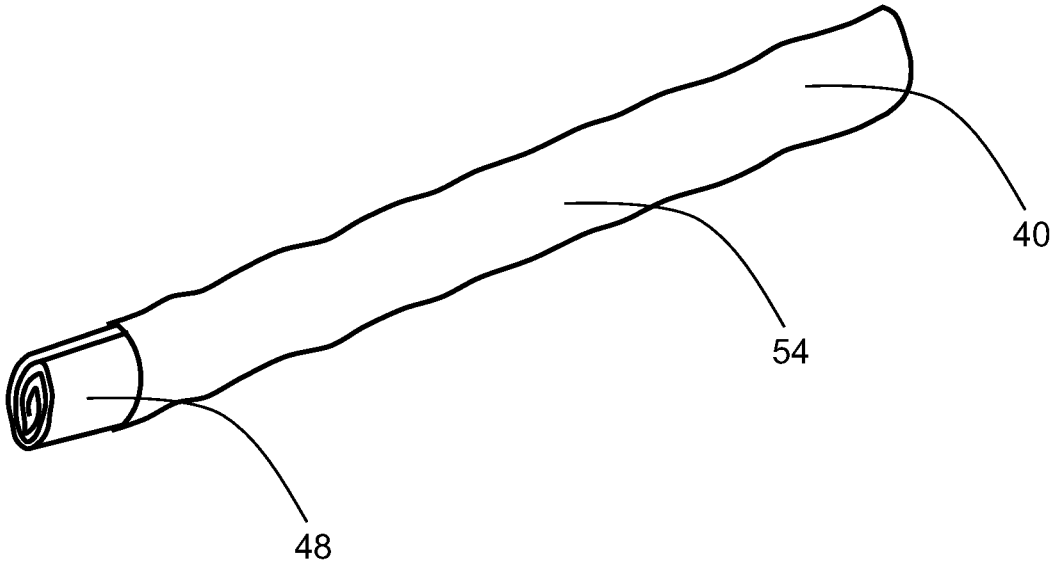
Figure 15C:
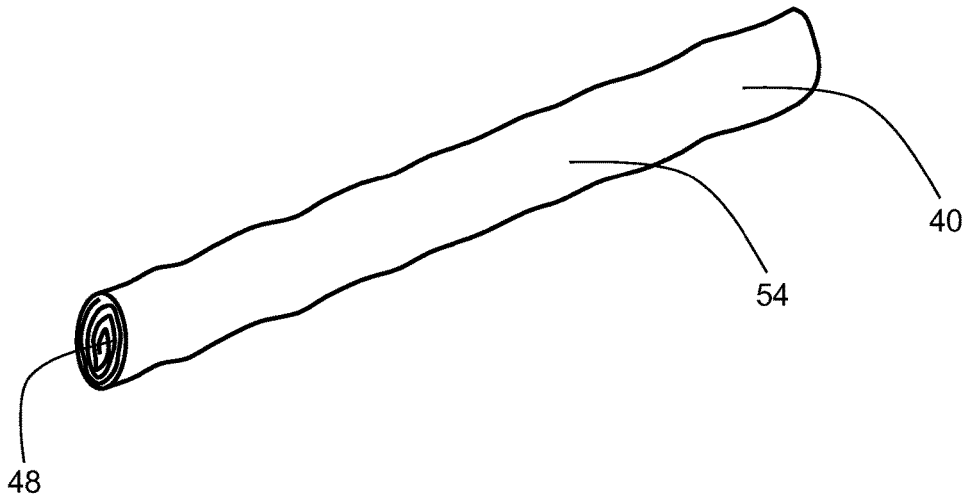
Figure 15D:
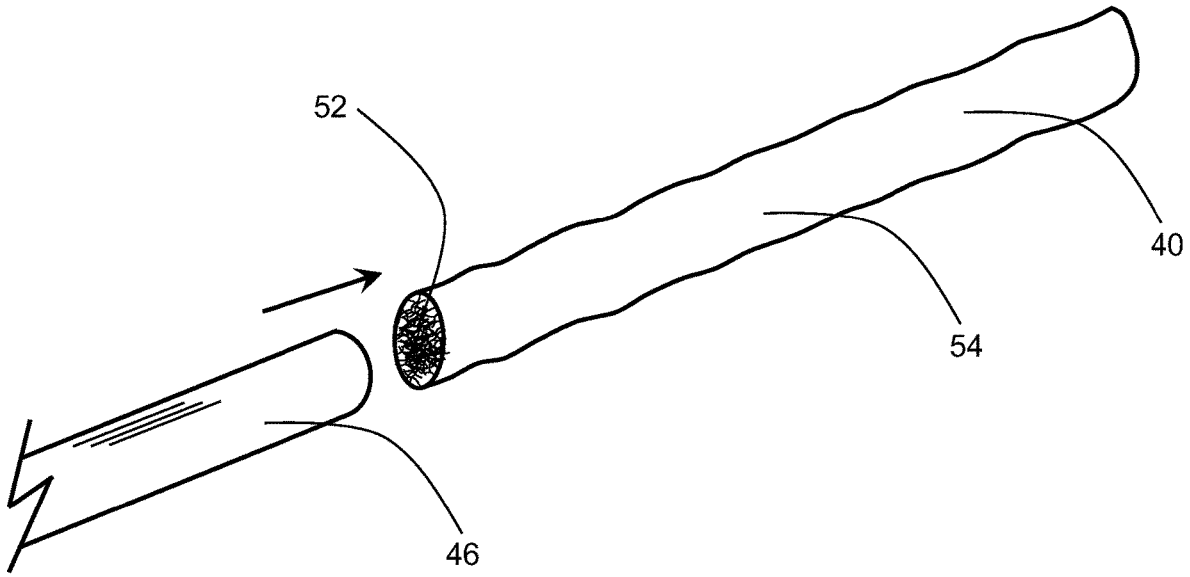
Figure 15E:
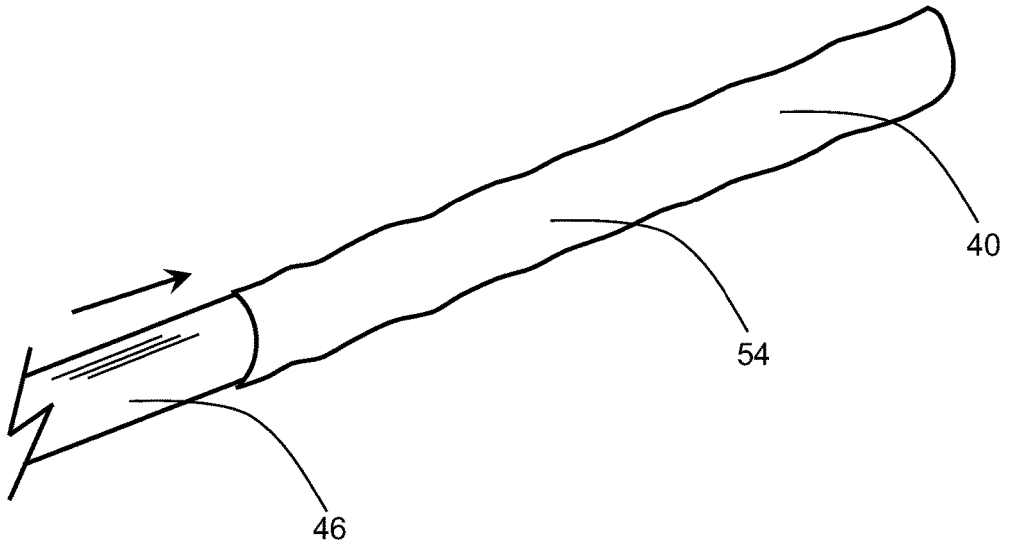
Figure 15F:
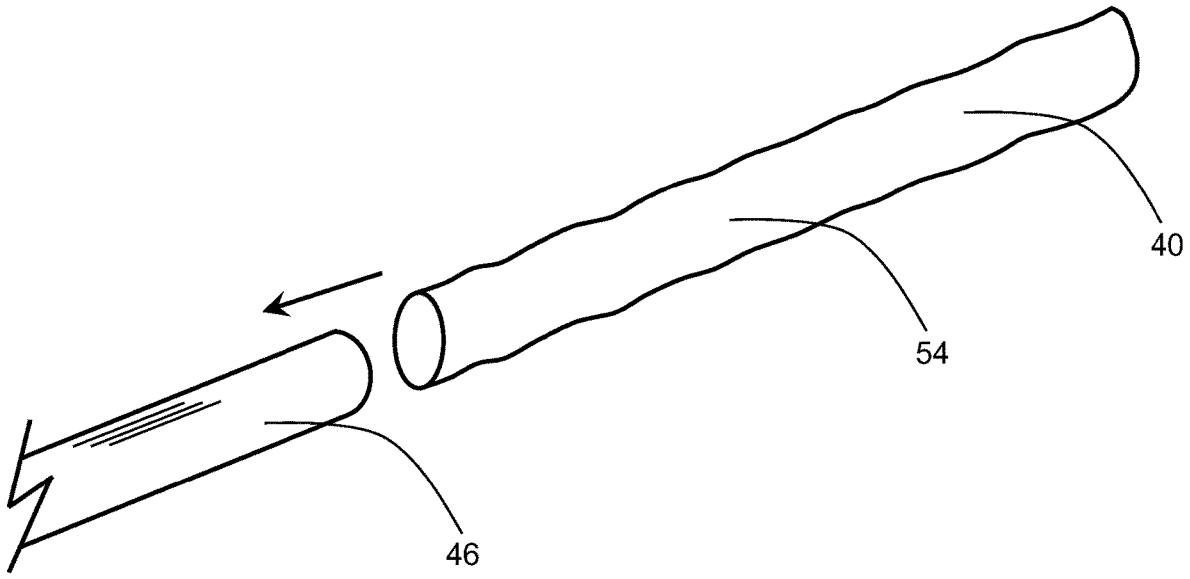
Figure 16A:
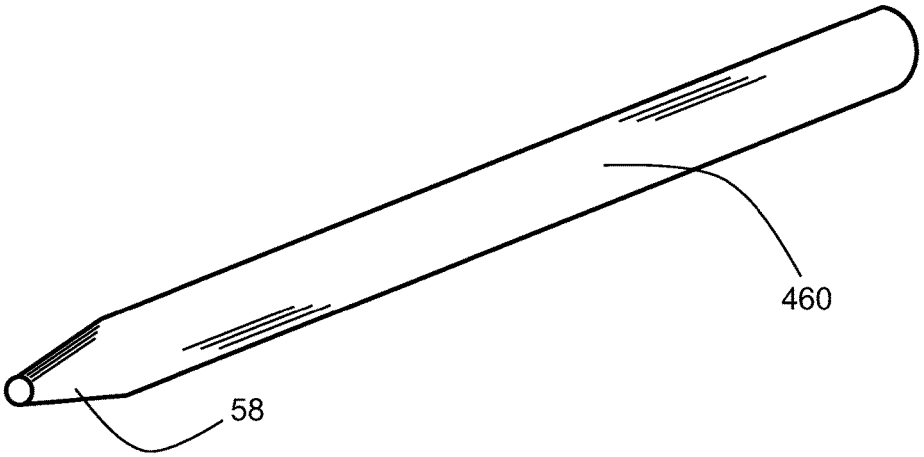
FIGS. 16A-16D are perspective views of a packing stick according to another embodiment of the present inventions.
Figure 16B:
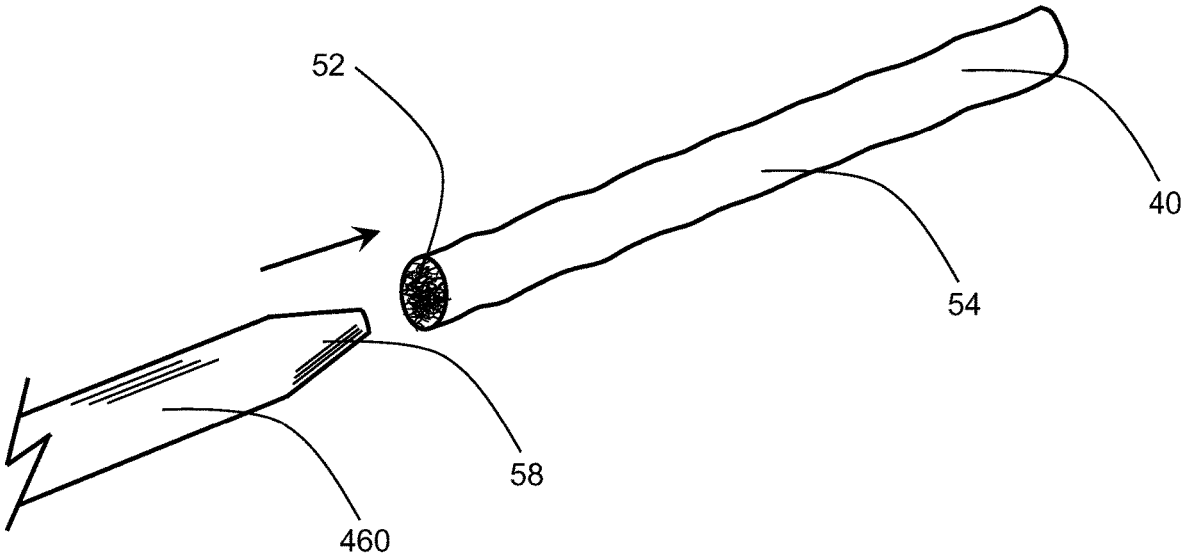
Figure 16C:
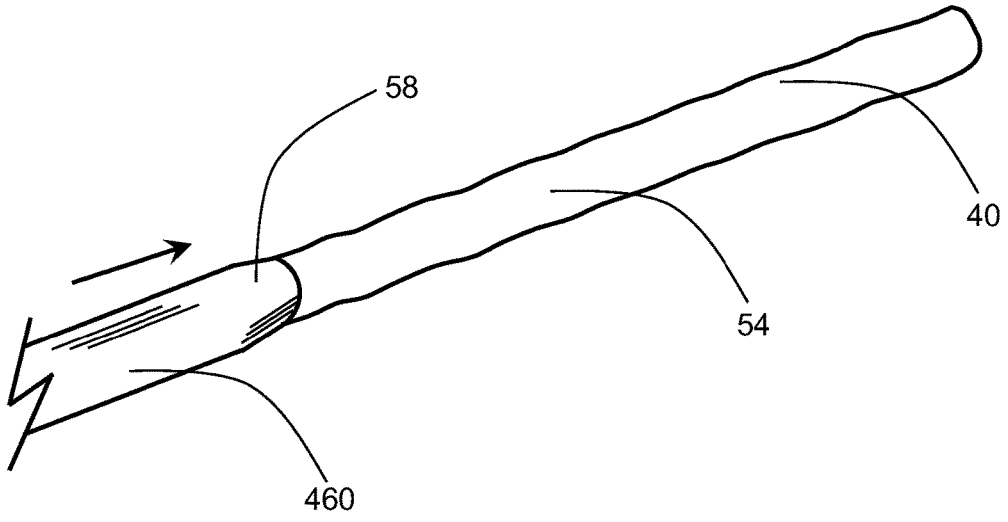
Figure 16D:
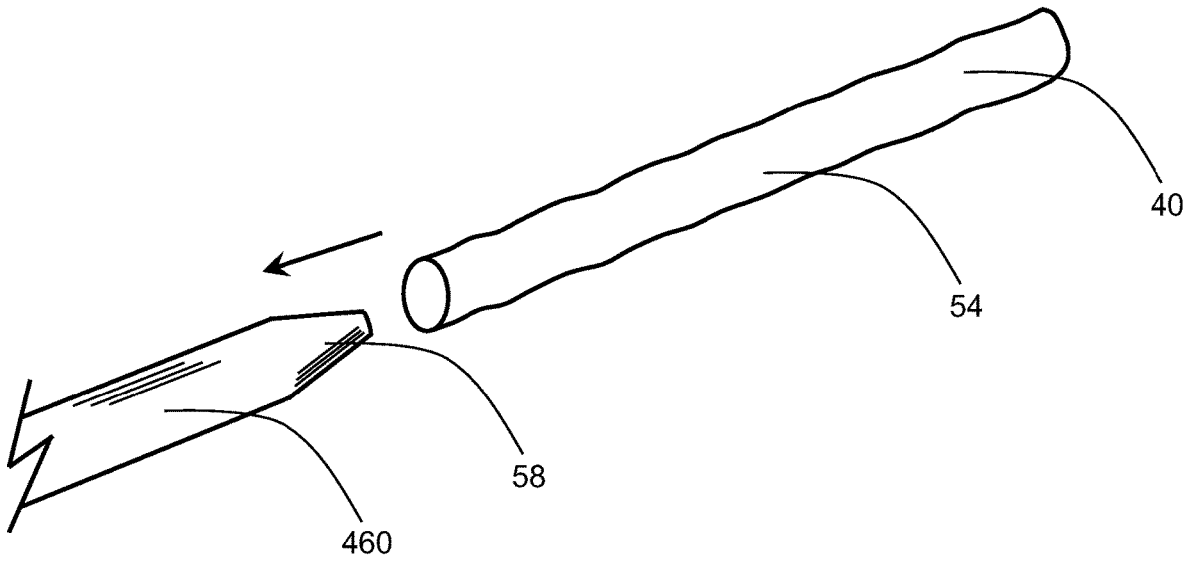

With the new cigarette 54 properly formed, filter tip 48 may be removed from package 10 and rolled into a cylinder as well, the diameter of filter tip 48 being less than diameter of paper 40 cylinder. When filter tip 48 has been rolled into the shape of a cylinder, filter tip 48 may be introduced to one end of the cigarette 54 and pressed into the inner cylinder of the cigarette thereby compressing the tobacco product within the cigarette as illustrated in FIGS. 15A-15C. Filter tips 48 may be added to cigarette 54 to prevent some unwanted inhalants from reaching the user, provide support and a handling area for the cigarette and provide a portion the cigarette that can be introduced into one's mouth without having to be concerned with the risk of burns from the burning tobacco.

With filter tip 48 now in place, packing stick 46 may be removed from sleeve 44 of package 10. Packing stick 46 is generally cylindrical in shape has a diameter that is smaller than the diameter of paper 40 cylinder and may be introduced to cigarette 54 at an opposite end of filter tip 48 to compact the tobacco further with in cigarette 54, as illustrated in FIGS. 15 D-15F to ensure a denser tobacco consistency to enable a more even burning of the tobacco within the cigarette and a more enjoyable experience for the end user. With the tobacco properly packed within the cigarette, the use may introduce an ignition source, such as a match or lighter, to the unfiltered end of cigarette 54 to ignite paper 40 and the tobacco and begin to enjoy their smoking experience.

In another embodiment of the present invention depicted in FIGS. 16A-16D, packing stick 460 may include a tip 58 formed as a frustum. Tip 58 provides for a multiple number of outer diameters versus the single diameter provided by packing stick 46. Tip 58 may be used when an individual desires a cigarette having a thinner profile and smaller inner diameter of cylindrical opening than the outer diameter of packing stick 46. Frustum tip 58 of packing stick 460 enables the individual to compact the tobacco within cigarette 54 even if the inner diameter of cigarette 54 is less than the outer diameter of packing stick 46. Packing stick 460 with coned tip 58 will enable a cigarette created with any size inner diameter and profile will have an even density of tobacco throughout the entirety of the cigarette thus ensuring an enjoyable smoking experience for the individual.

Figure 17A:
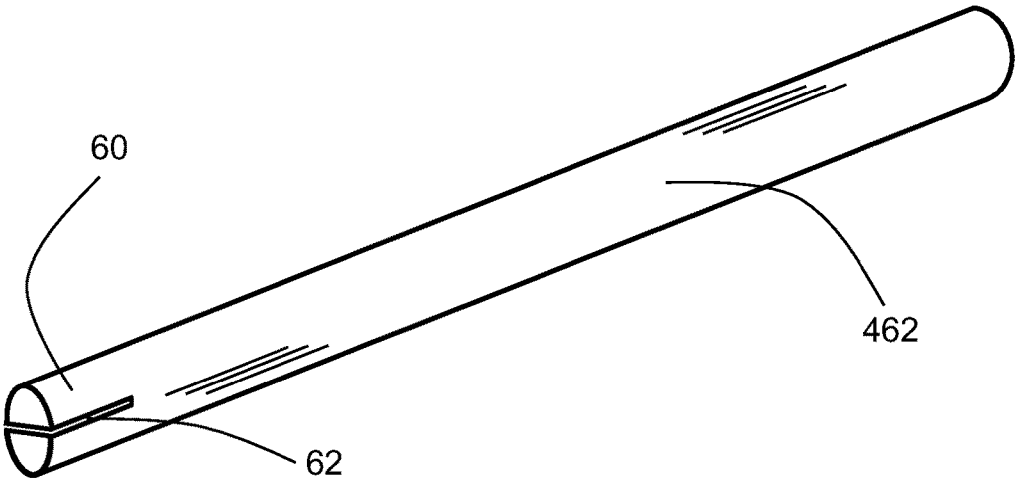
FIGS. 17A-17F are perspective views of a packing stick according to yet another embodiment of the present invention.
Figure 17B:
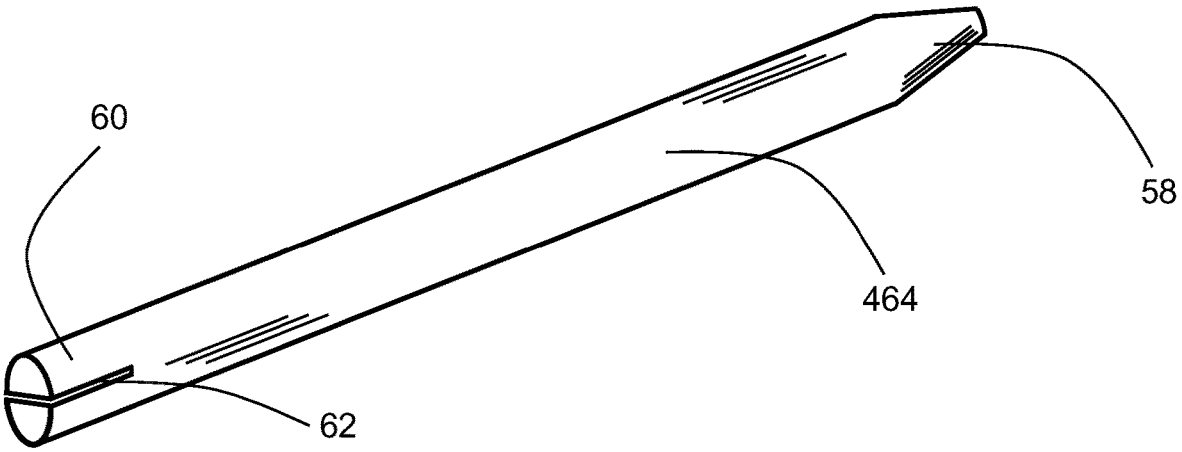
Figure 17C:
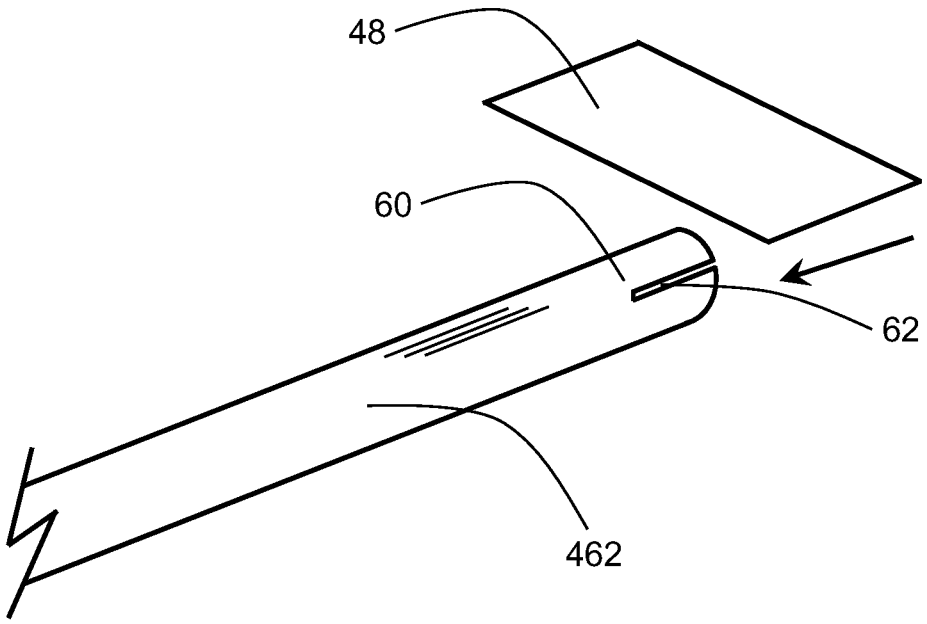
Figure 17D:
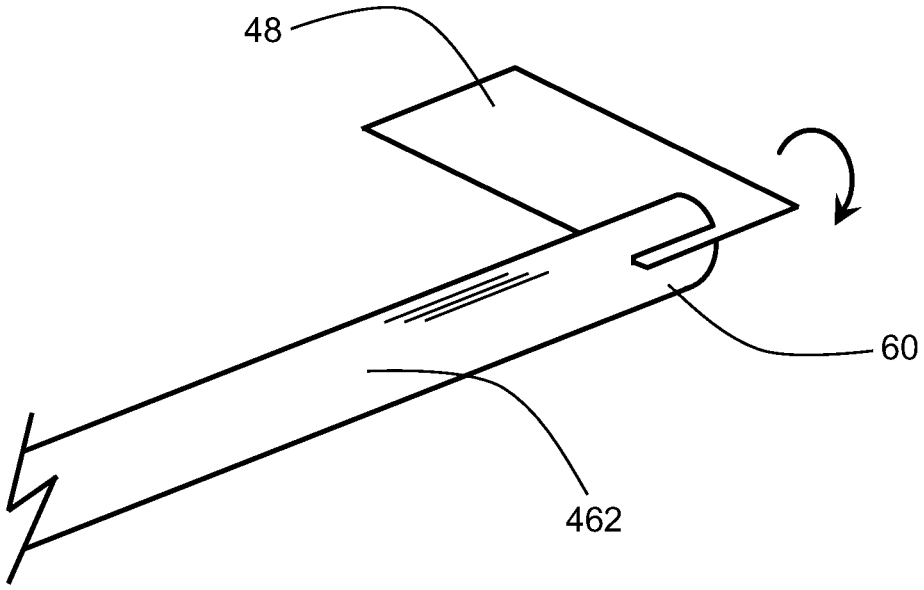
Figure 17E:
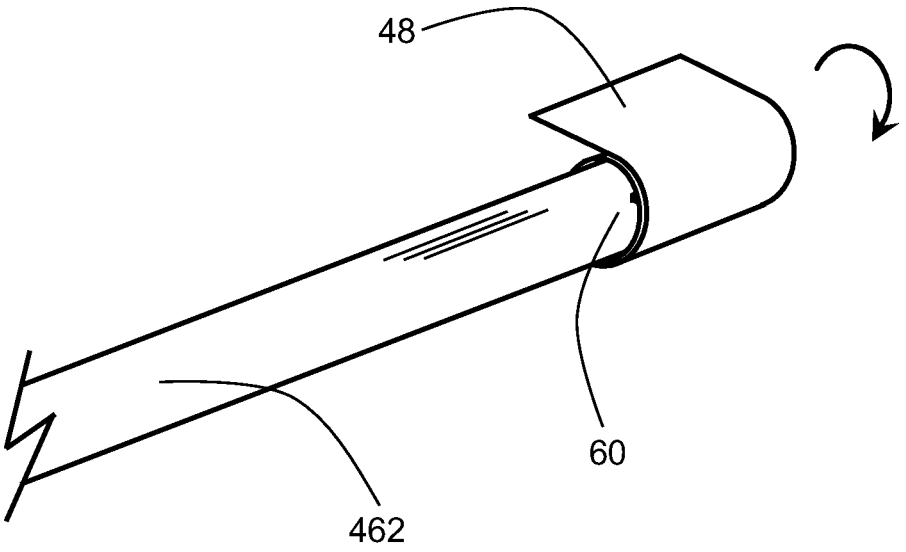
Figure 17F:
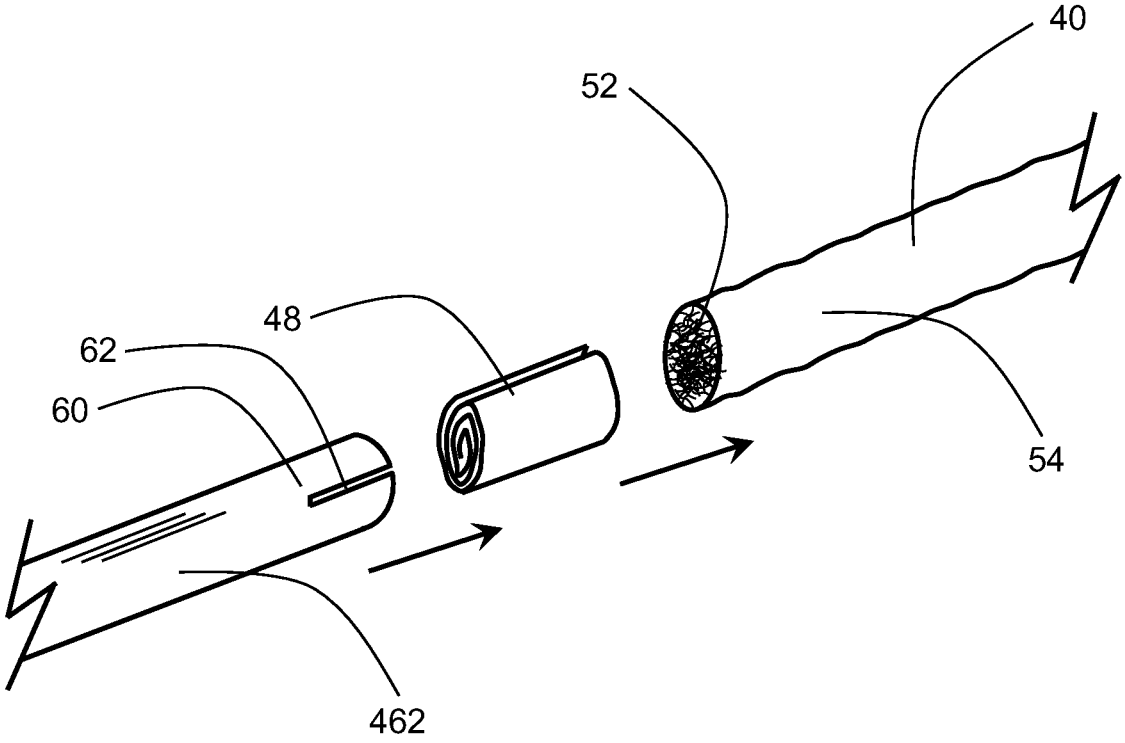

In yet another embodiment of the present invention illustrated in FIGS. 17A-17F, packing stick 462 may include a tip 60 having a slot 62. Tip 60 and slot 62 enable an individual to transform filter tip 48 from the initial flat piece when filter tip 48 is removed from package 10 at spine 56, to a cylindrical filter tip 48 as depicted in FIGS. 15A, 15B and 17F. An end of filter tip 48 may be introduced into slot 62 of tip 60 as shown in FIG. 17C. Packing stick 462 may be rotated in a direction that enables filter tip 48 to wrap around packing stick 462 and about itself as illustrated in FIG. 17E. Filter tip 48 may be removed from packing stick 462 and inserted into and end of cigarette 54 as shown in FIGS. 17F and 15B. Slot 62 at tip 60 of packing stick 462 enables an individual to easily prepare a filter tip 48 for insertion into an end of cigarette 54. As described above, filter tips 48 may be added to cigarette 54 to prevent some unwanted inhalants from reaching the user, provide support and a handling area for the cigarette and provide a portion the cigarette that can be introduced into one's mouth without having to be concerned with the risk of burns from the burning tobacco.

FIG. 17B illustrates still another packing stick 464 that includes a frustum tip 58 at one end and a tip 60 having a slot 62 at a second end to combine both of the above described features into one packing stick 464. The advantages of the features, frustum tip 58 and slotted 62 tip 60, have been described above.

The present invention has been particularly shown and described with reference to the foregoing embodiment, which is merely illustrative of the best modes presently known for carrying out the invention. It should be understood by those skilled in the art that various alternatives to the embodiment of the invention described herein may be employed in practicing the invention without departing from the spirit and scope of the invention as defined in the following claims. It is intended that the following claims define the scope of the invention and that the method within the scope of these claims and their equivalents be covered thereby. This description of the invention should be understood to include all novel and non-obvious combination of elements described herein, and claims may be presented in this or a later application to any novel non-obvious combination of these elements. Moreover, the foregoing embodiment is illustrative, and no single feature or element is essential to all possible combinations that may be claimed in this or a later application.

What is claimed is:

1. A package for containing rolling papers used in at least one smoking article to be dispensed therefrom, said package comprising:

a plurality of rolling papers, said plurality of rolling papers including a crease to capture a smoking product on said rolling papers and said rolling papers being rolled into a cylindrical shape to capture the smoking product within said rolling papers to create said at least one smoking article;

a base, said base including a container, said container sized for holding said plurality of rolling papers and said container including a slot to dispense said plurality of rolling papers, said plurality of rolling papers used to fabricate hand rolled cigarettes;

a first tab, said first tab extending outward from said base at a wide side of said base;

a cover, said cover extending outward from said first tab;

a second tab, said second tab extending outward from said cover at a wide side of said cover;

a scooper sleeve, said scooper sleeve extending outward from said second tab;

a spine, said spine extending outward and perpendicular from said cover;

a plurality of filter tips, said plurality of filter tips secured to said cover at said spine and said plurality of filter tips extending outward from said spine;

a packing stick;

a sleeve, said sleeve positioned at an intersection of said first tab and said cover; said sleeve sized to secure said packing stick within an interior of said package; and wherein said scooper sleeve is folded at said second tab onto said filter tabs and said base is folded at said first tab onto said scooper sleeve to enable said package to be folded upon itself and stored compactly.

2. The package as recited in claim 1, wherein said spine is depressed to enable a curved edge in said scooper sleeve, said curved edge extends a length of said scooper sleeve opposite said second tab and is sized to slide on a surface and engage the smoking product and said scooper sleeve is sized to capture the smoking product on said package.

3. The package as recited in claim 1, wherein said filter tip may be removed from said package at said spine, said filter tip rolled into a cylindrical shape having an outer diameter less than the inner diameter of the smoking articles and said filter tip being inserted into an end of said cylindrically shaped rolling papers of the smoking articles.

4. The package as recited in claim 1, wherein said packing stick is shaped as a cylinder having an outer diameter less than the inner diameter of the smoking articles, said packing stick sized to be inserted into one end of the smoking article to compress the smoking product within said rolling papers.

5. The package as recited in claim 1, wherein said packing stick includes a first tip, said first tip being shaped in the form of a frustum, said frustum sized to be inserted into one end of the smoking article to compress the smoking product within said rolling papers.

6. The package as recited in claim 1, wherein said packing stick includes a second tip, said second tip including a slot, said slot sized to accept an end of said filter tip.

7. The package as recited in claim 6, wherein said packing stick may be rotated in a first direction to wrap said filter tip about said packing stick and said filter tip to create a cylindrical filter tip, said filter tip being removed from said packing stick and said filter tip being inserted into an end of said cylindrically shaped rolling papers of the smoking article.

* * * * *